US009010102B2

(12) United States Patent
Bang et al.

(10) Patent No.: US 9,010,102 B2
(45) Date of Patent: Apr. 21, 2015

(54) DEVICE AND METHOD FOR CONTROLLING HYDRAULIC PUMP OF CONSTRUCTION MACHINERY

(75) Inventors: Jae Seok Bang, Gyeonggi-do (KR); Woo Yong Jung, Seoul (KR); Won Sun Sohn, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 546 days.

(21) Appl. No.: 13/510,814

(22) PCT Filed: Nov. 1, 2010

(86) PCT No.: PCT/KR2010/007579

§ 371 (c)(1),
(2), (4) Date: May 18, 2012

(87) PCT Pub. No.: WO2011/062379

PCT Pub. Date: May 26, 2011

(65) Prior Publication Data

US 2012/0227391 A1 Sep. 13, 2012

(30) Foreign Application Priority Data

Nov. 18, 2009 (KR) ..... 10-2009-0111498

(51) Int. Cl.

| | |
|---|---|
| ***F15B 15/20*** | (2006.01) |
| ***F04B 49/08*** | (2006.01) |
| ***E02F 9/12*** | (2006.01) |
| ***E02F 9/22*** | (2006.01) |

(52) U.S. Cl.

CPC ..... *F04B 49/08* (2013.01); *E02F 9/123* (2013.01); *E02F 9/2235* (2013.01); *E02F 9/2282* (2013.01); *E02F 9/2292* (2013.01); *E02F 9/2296* (2013.01)

(58) Field of Classification Search

CPC ..... F04B 49/08; E02F 9/123; E02F 9/2235; E02F 9/2282; E02F 9/2292; E02F 9/2296

USPC ..... 60/430, 445, 452, 428

See application file for complete search history.

(56) References Cited

FOREIGN PATENT DOCUMENTS

JP 11-303150 11/1999

(Continued)

OTHER PUBLICATIONS

Search Report for PCT Application No. PCT/KR2010/007579, dated Jun. 29, 2011, 3 pages.

*Primary Examiner* — Dwayne J White
*Assistant Examiner* — Logan Kraft
(74) *Attorney, Agent, or Firm* — John D. Veldhuis-Kroeze; Westman, Champlin & Koehler, P.A.

(57) ABSTRACT

The present invention relates to a device for controlling a hydraulic pump of construction machinery. The device has a first pump supplying working fluid through a swing control valve to a swing motor, and a second pump supplying working fluid through a work tool control valve to a work tool actuator, and includes: a first tilting angle control unit for controlling a discharge flow of the first pump by controlling a tilting angle of the first pump according to an input pump control signal; and a controller deducting a discharge pressure (P2) of the second pump from a discharge pressure (P1) of the first pump to calculate a pump difference pressure-(P1-P2), comparing the calculated pump difference pressure (P1-P2) to a reference difference pressure and, when the calculated pump difference pressure (P1-P2) is greater than the reference difference pressure, outputting the pump control signal to the first tilting angle control unit to make the discharge pressure (P1) of the first pump equal to or less than a first reference pressure that is less than or equal to a swing relief pressure.

6 Claims, 6 Drawing Sheets

(56) References Cited

FOREIGN PATENT DOCUMENTS

| | | | |
|---|---|---|---|
| JP | 2009-103227 | | 5/2009 |
| KR | 1995-0008533 | | 7/1995 |
| KR | 1020060108850 | A | 10/2006 |
| KR | 100773987 | B1 | 10/2007 |
| KR | 100797320 | B1 | 1/2008 |

DEVICE AND METHOD FOR CONTROLLING HYDRAULIC PUMP OF CONSTRUCTION MACHINERY

This Application is a Section 371 National Stage Application of International Application No. PCT/KR2010/007579, filed Nov. 1, 2010 and published, not in English, as WO2011/062379 on May 26, 2011.

FIELD OF THE DISCLOSURE

The present disclosure relates to a device and a method for controlling a hydraulic pump of construction machinery such as an excavator, and more particularly, to a device and a method for controlling a hydraulic pump of construction machinery, which use a simplified structure to improve fuel efficiency by reducing the swing relief flow in a swing motor and a main relief flow in a system.

BACKGROUND OF THE DISCLOSURE

In general, construction machinery such as an excavator includes a plurality of actuators for moving the machinery or for driving various work tools and an upper swing body. The plurality of actuators is driven by working fluid discharged from a variable capacity hydraulic pump.

However, there are instances in which the flow discharged from a hydraulic pump exceeds the flow that may be supplied to each actuator when each actuator is stalled or under high load working conditions in a hydraulic system for the above-described constuction machinery. In this case, the surplus flow increases the pressure in the hydraulic system, and when the increased pressure of the working fluid exceeds a relief pressure, the working fluid drains into a tank through a relief valve. Here, the working fluid that drains through the relief valve is of a high pressure that exceeds the relief pressure, and causes a great loss of power in the system.

In particular, because an upper swing body has high inertia, a large portion of the flow of working fluid supplied to the swing motor at the onset of driving the upper swing body is drained into the tank through the swing relief valve, so that the working fluid drained through the swing relief valve causes a large loss of power. In order to reduce such a loss of power, technology is being developed to reduce the flow discharged from a hydraulic pump during swing operation, an example of which is disclosed in Korean Patent Publication No. 2004-0080177.

In a flow control device of a hydraulic pump proposed in the above Korean patent publication, many hydraulic pressure components are needed such as a load pressure sensing passage, a shuttle valve, a pressure intensifier, and a solenoid valve, to sense whether a control valve for a swing motor has been switched, in order to perform controlling to reduce the discharging flow of the hydraulic pump under the relief conditions of the swing motor. Accordingly, when a hydraulic pressure system such as that in the above Korean patent publication is employed, not only is the structure of construction machinery made more complicated, the cost thereof also rises. Also, not only does the pressure loss due to the added hydraulic pressure components cause greater overall loss, but the reliability of the hydraulic pressure system may be diminished.

The discussion above is merely provided for general background information and is not intended to be used as an aid in determining the scope of the claimed subject matter.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Accordingly, it is one aspect of the present disclosure to provide a device and a method for controlling a hydraulic pump of construction machinery that can have a simplified structure and minimize loss of power by minimizing the amount of flow through a relief valve that is drained.

In order to one aspect of the present disclosure, an exemplary embodiment of the present disclosure provides a device for controlling a hydraulic pump for construction machinery, having a first pump 10 supplying working fluid through a swing control valve 31 to a swing motor 30, and a second pump 20 supplying working fluid through a work tool control valve 41 to a work tool actuator 40. According to an exemplary embodiment of the present disclosure, the device includes: a first tilting angle control unit 12 for controlling discharging flow of the first pump 10 by controlling a tilting angle of the first pump 10 according to an input pump control signal; and a controller 60 deducting a discharge pressure P2 of the second pump 20 from a discharge pressure P1 of the first pump 10 to calculate a pump difference pressure P1-P2, comparing the calculated pump difference pressure P1-P2 to a reference difference pressure and, when the calculated pump difference pressure P1-P2 is greater than the reference difference pressure, outputting the pump control signal to the first tilting angle control unit 12 to make the discharge pressure P1 of the first pump 10 equal to or less than a first reference pressure that is less than or equal to a swing relief pressure.

The device may further include a second tilting angle control unit 22 controlling a discharge flow of the second pump 20 by controlling a tilting angle of the second pump 20 according to the pump control signal input from the controller 60, and the controller 60 may output the pump control signal to the first and the second tilting angle control units 12 and 22, such that when the pump difference pressure P1-P2 is less than the reference difference pressure, a greater discharge pressure from among the discharge pressure P1 of the first pump 10 and the discharge pressure P2 of the second pump 20 is made greater than the swing relief pressure and less than a main relief pressure.

The first tilting angle control unit 12 may include: a first regulator 13 controlling a tilting angle of the first pump 10 according to an input pilot pressure; and a first electronic proportional pressure reduction valve 14 controlling the pilot pressure input to the first regulator 13 according to the input pump control signal.

Another exemplary embodiment of the present disclosure provides a method for controlling a hydraulic pump for construction machinery, having a first pump 10 supplying working fluid through a swing control valve 31 to a swing motor 30, and a second pump 20 supplying working fluid through a work tool control valve 41 to a work tool actuator 40, the method including: a) a step of calculating a pump difference pressure P1-P2 by deducting a discharge pressure P2 of the second pump 20 from a discharge pressure P1 of the first pump 10; b) a step of a determing that a current working state is a single operation when the pump difference pressure P1-P2 is greater than a reference difference pressure, and determing that the current working state is not a single operation when the pump difference pressure P1-P2 is less than the reference difference pressure; and c) a step of controlling a discharge flow of the first pump 10 by making the discharge pressure P1 of the first pump 10 equal to or less than a first reference pressure that is less than or equal to a swing relief pressure, when the current working state is determined to be a single operation.

The method may further include d) a step of controlling discharge flow of the first and the second pump 10 and 20 by making a greater discharge pressure from among the discharge pressure P1 of the first pump 10 and the discharge pressure P2 of the second pump 20 equal to or less than a second reference pressure that is greater than the swing relief pressure and less than a main relief pressure, when the current working state is determined to not be a single operation.

Step c) may include: c1) a step of comparing the discharge pressure P1 of the first pump 10 with the first reference pressure; and c2) a step of controlling a discharge flow of the first pump 10 by maintaining the discharge pressure P1 of the first pump 10 at the first reference pressure, when the discharge pressure P1 of the first pump 10 is greater than the first reference pressure.

According to the exemplary embodiments of the present disclosure, by determining whether a current working state is a single operation from a discharge pressure difference between a first pump and a second pump, additional components such as a load pressure sensing passage, a shuttle valve, a pressure intensifier, and a solenoid valve that were previously required to determine whether to perform a swing operation can be omitted, and thus, costs can be reduced.

Also, when it is determined that the current working state is a single operation, by controlling the discharge flow of a first pump to be less than a first standard pressure, at which the discharge pressure of the first pump is less than or the same as a swing relief pressure, the flow of working fluid drained through a swing relief valve can be minimized, and thus, fuel efficiency can be improved.

In addition, when it is determined that the current working state is not a single operation, discharge flows of a first and second pump are controlled to be less than a second reference pressure, at which the greater discharge pressure of the first and second pump discharge pressures is greater than the swing relief pressure but less than a main relief pressure, so that even when the current working state is not a single operation but is a multiple working state, the flow of working fluid drained through the main relief valve can be minimized, and thus, the fuel efficiency of construction machinery can be maximized.

Also, by configuring a tilting angle control unit with a regulator and an electronic proportional pressure reduction valve, the device for controlling a hydraulic pump of the present disclosure can also be applied to a mechanical hydraulic system for controlling a tilting angle of a pump with a pilot pressure.

DETAILED DESCRIPTION

Hereinafter, a device and method for controlling a hydraulic pump of construction machinery according to exemplary embodiments of the present disclosure will be described in detail with reference to the accompanying drawings.

Figure 1:
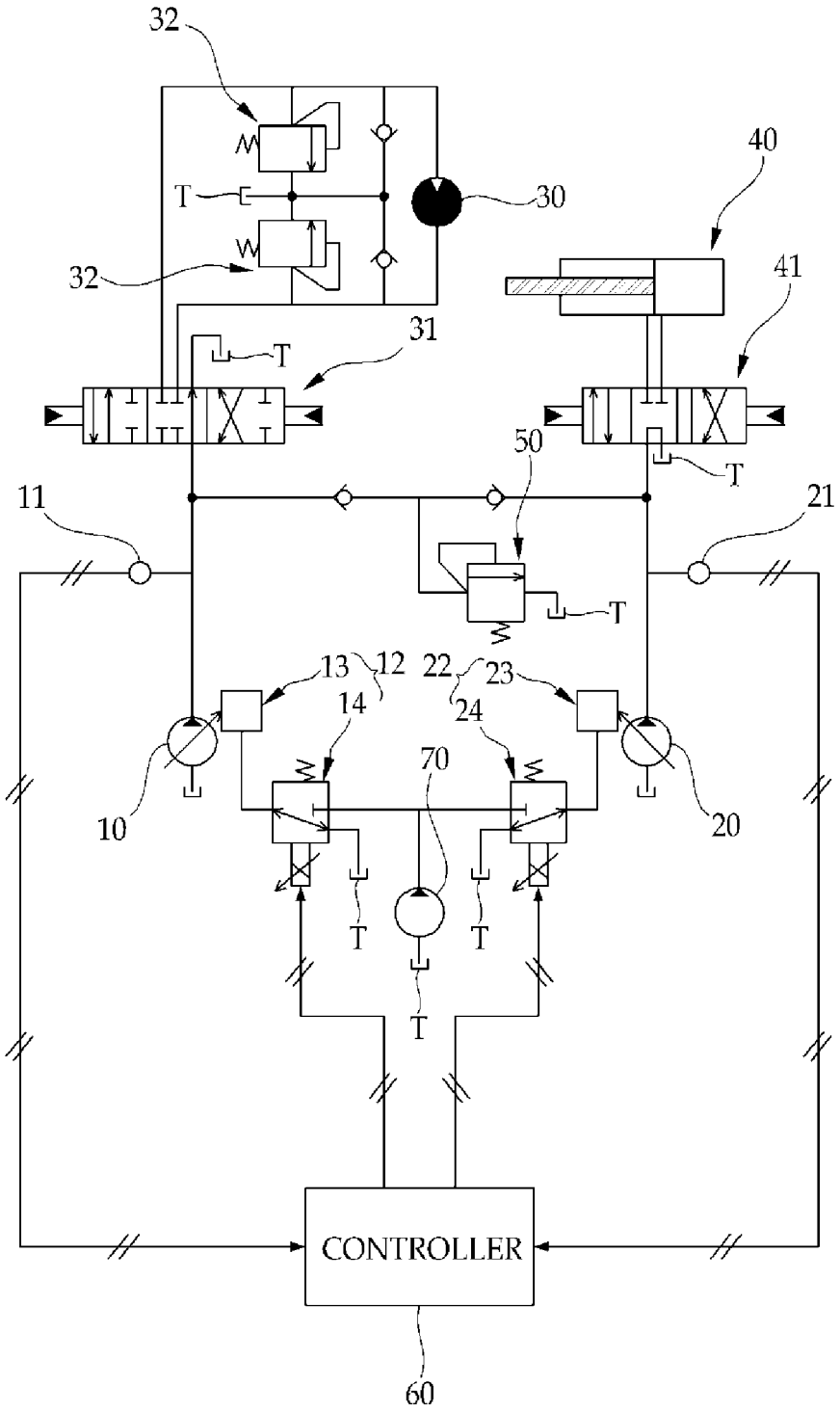
FIG. 1 is a circuit diagram schematically illustrating a hydraulic system for construction machinery to which a device for controlling a hydraulic pump according to an exemplary embodiment of the present disclosure is applied.

Referring to FIG. 1, a device for controlling a hydraulic pump of construction machinery according to an exemplary embodiment of the present disclosure is for minimizing the flow of working fluid drained through a swing relief valve 32 and a main relief valve 50 by controlling the discharge flows of a first pump 10 and a second pump 20, and includes: a first and second tilting angle control unit 22 for controlling the tilting angles of the first and second pumps 10 and 20, respectively; a first and second pressure sensor 11 and 21 for sensing the respective discharge pressures P1 and P2 of the first and second pumps 10 and 20; and a controller 60 for outputting a pump control signal to the first and second tilting angle control units 12 and 22 on the basis of the discharge pressures P1 and P2 sensed by the first and second pressure sensors 11 and 21.

Working fluid discharged from the first pump 10 is controlled in the flow direction thereof by a swing control valve 31 and is supplied to a swing motor 30. The swing motor 30 has a swing relief valve 32 installed thereon, and the swing relief valve 32 drains the working fluid of the swing motor 30 into a drain tank T when the working fluid reaches a pressure greater than a swing relief pressure. In the present exemplary embodiment, only one swing motor 30 has been exemplary described as an actuator driven by working fluid of the first pump 10, but unlike the present exemplary embodiment, a plurality of actuators may be installed to be driven by the first pump 10.

Working fluid discharged from the second pump 20 is controlled in the flow direction thereof by a work tool control valve 41 and is supplied to a work tool actuator 40. In the present exemplary embodiment, the work tool actuator 40 driven by working fluid from the second pump 20 has been exemplarily described as one, but may alternately be configured as a plurality of actuators such as a boom cylinder, an arm cylinder, and a bucket cylinder, in which case, each of the plurality of actuators has a work tool control valve connected thereto.

A main relief valve 50 is installed in a passage connected to the first and the second pumps 10 and 20, and the main relief valve 50 drains working fluid into a drain tank T when the discharge pressures P1 and P2 of the first and the second pump 10 and 20 rise above a main relief pressure. That is, the main relief valve 50 is for preventing the overall pressure of a hydraulic system from rising above an allowable pressure.

The technical spirit of the present disclosure is for minimizing the flow of working fluid that is drained through the swing relief valve 32 and the main relief valve 50, and especially when the current working state is a single operation, the discharge pressure P1 of the first pump 10 is controlled to be less than a swing relief pressure to minimize the working fluid that is drained through the swing relief valve 32, and when the current working state is not a single operation, the pressure of the first and the second pump 10 and 20 is controlled to be less than a main relief pressure to minimize the flow of working fluid drained through the main relief valve 50. Hereinafter, configurations for embodying this technical spirit will be described.

The first tilting angle control unit 12 is for controlling the tilting angle of the first pump 10 according to an input pump control signal in order to control the discharge flow from the first pump 10, and includes a first regulator 13 for controlling the tilting angle of the first pump 10 according to an input pilot pressure, and a first Electronic Proportional Pressure Reduction (EPPR) valve 14 for controlling a pilot pressure input to the first regulator 13.

The first regulator 13 is connected to a pilot pump 70 with the first EPPR valve 14 therebetween. When a high pilot pressure is input, the first regulator 13 drives a swash plate of the first pump 10 in a direction in which flow is reduced, and drives the swash plate of the first pump 10 in a direction in which flow is increased when a low pilot pressure is input. In addition to the pilot pressure controlled by the first EPPR valve 14, the first regulator 13 may have a negacon pressure at the end of a center bypass passage, a posicon pressure generated by manipulating a control lever, or a load sensing pressure sensed from each actuator input thereto.

The first EPPR valve 14 is installed between the pilot pump 70 and the first regulator 13, and controls the pilot pressure input to the first regulator 13 by controlling an opened amount of a passage connecting the pilot pump 70 and the first regulator 13. Accordingly, when a pump control signal that is a high current command is input, the first EPPR valve 14 increases the opened amount of the passage connecting the pilot pump 70 and the first regulator 13. Thus, the pilot pressure input to the first regulator 13 is increased, and the flow from the first pump 10 is reduced. An example of this is illustrated in FIG. 6.

Figure 6:
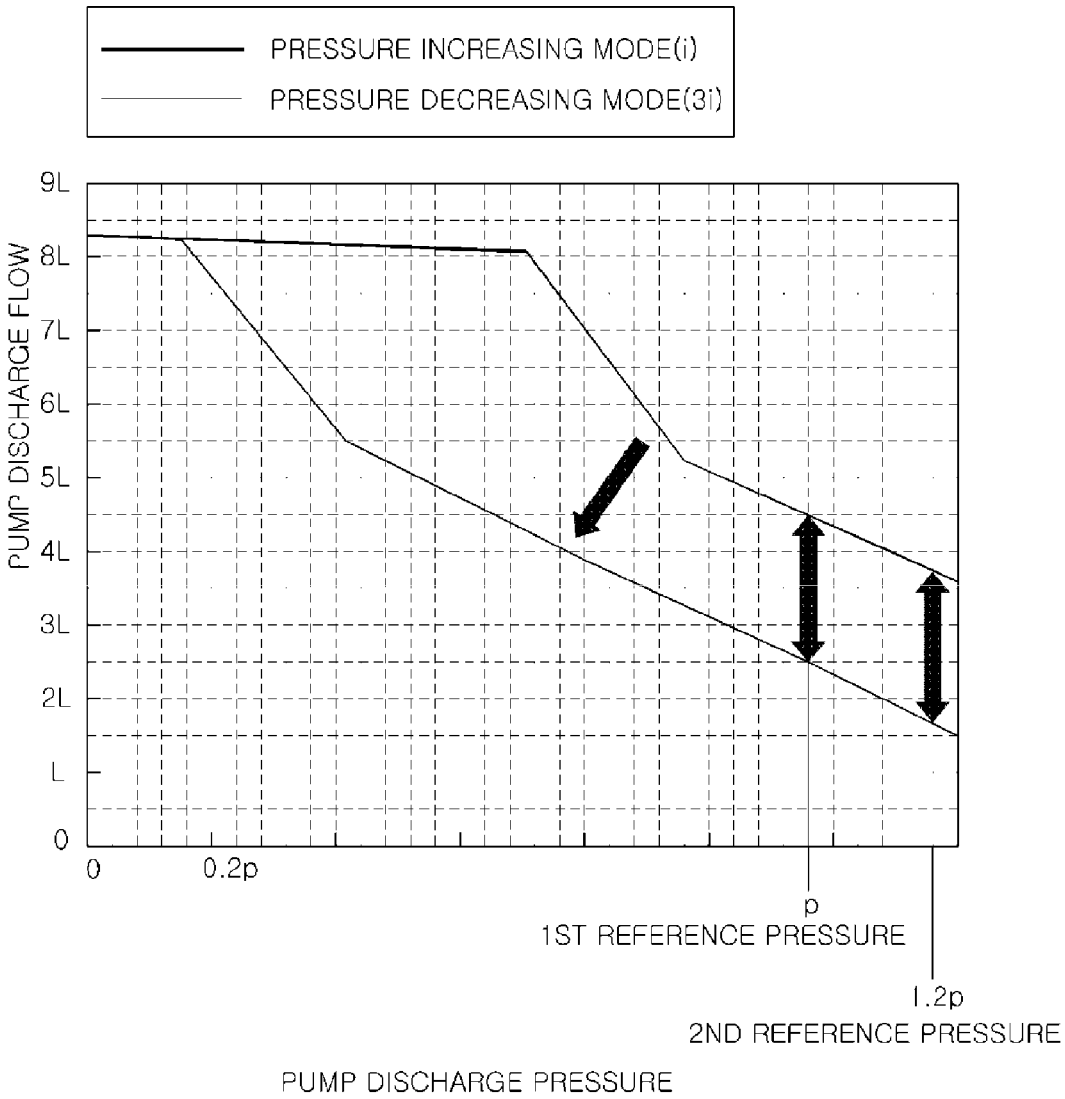
FIG. 6 is a graph schematically illustrating a pressure increasing mode for which the pump discharge flow is set with respect to pump discharge pressure and a pressure decreasing mode for decreasing pressure from pressure increasing mode.

FIG. 6 illustrates pump discharge flow with respect to pump discharge pressure, where the curve depicted by a dotted line is a graph representing the state in which a pump control signal "i" is input to the first EPPR valve 14 (hereinafter called 'pressure increasing mode'), and the curve depicted by a solid line is a graph representing the state in which a pump control signal "3*i*" is input (hereinafter called 'pressure decreasing mode'). Referring to FIG. 6, the discharge flow in pressure increasing mode is less than the discharge flow in pressure decreasing mode, for the same pressure. That is, pressure increasing mode is one in which high power may be output from a pump due to a large discharge flow of the pump, and thus, the swing motor 30 or the work tool actuator 40 may be driven with high power. Conversely, the pressure decreasing mode is one in which the discharge flow of the pump is less than in the pressure increasing mode, so that the pump outputs lower power than the pressure increasing mode, and thus, the swing motor 30 or the actuator 40 is driven with less power.

In other words, when the current command of a pump control signal is reduced, the discharge flow of the pump may be increased to increase the discharge pressure of the pump, and when the current command of the pump control signal is raised, the discharge flow of the pump may be be reduced to decrease the discharge pressure of the pump.

Accordingly, it is possible to reduce the flow of working fluid drained through the swing relief valve 32 and the main relief valve 50 by using the relationship between the current command of the pump control signal, the discharge flow of the pump, and the discharge pressure.

With the exception of the function for controlling the tilting angle of the second pump 20, the second tilting angle control unit 22 is the same as the first tilting angle control unit 12. In further detail, the second tilting angle control unit 22 includes a second regulator 23 and a second EPPR valve 24, and the structural and operating relationship thereof are the same as the first regulator 13 and the first EPPR valve 14, and thus, a detailed description will not be provided.

The first and the second pressure sensor 11 and 21 are for sensing the discharge pressures P1 and P2 of the first and the second pump 10 and 20, respectively, and the discharge pressures P1 and P2 sensed by the first and the second pressure sensor 11 and 21 are output to the controller 60.

The controller 60 is for calculating a pump control signal to output from the discharge pressures P1 and P2, sensed by the first and the second pressure sensor 11 and 21, to the first and the second tilting angle control unit 12 and 22. The detailed functions of the controller 60 will be described in detail in a section below describing a method for controlling a hydraulic pump.

Hereinafter, a description will be provided of a method for controlling, by a control device, a hydraulic pump having the above described structure.

Figure 3:
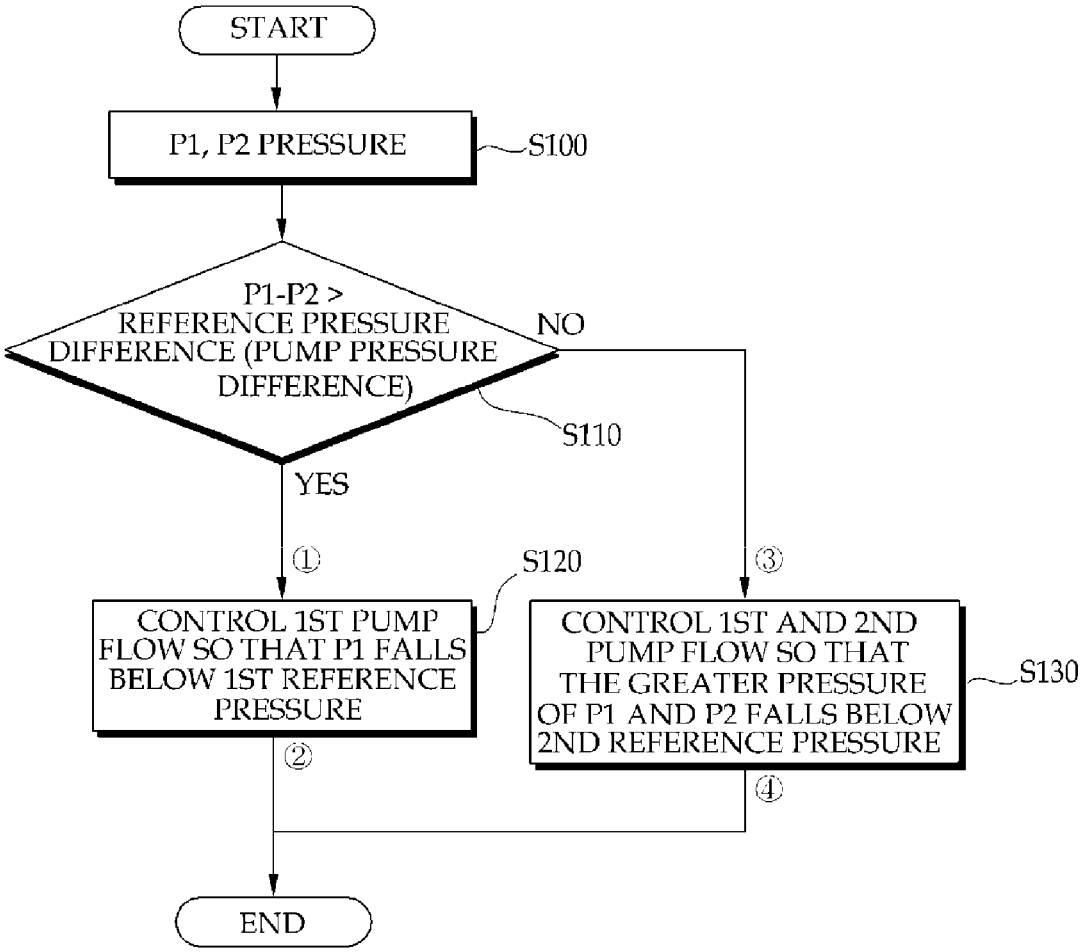
FIG. 3 is a signal flowchart for illustrating a method for controlling a hydraulic pump according to an exemplary embodiment of the present disclosure.

Referring to FIG. 3, first, the controller 60 in step S100 receives an input from the first and the second pressure sensor 11 and 21. Then, the controller 60 deducts a discharge pressure P2 of the second pump 20 from a discharge pressure P1 of the first pump 10 to calculate a pump difference pressure P1-P2, and the calculated pump difference pressure P1-P2 is compared to a reference difference pressure to determine whether the pump difference pressure P1-P2 is greater than the reference difference pressure in step S110. The determining step is to determine whether the current working state is a single operation, and when the determined results show that the pump difference pressure P1-P2 is greater than the reference difference pressure, the controller 60 determines that the current working state is a single operation.

In general, when the swing relief pressure of the swing relief valve 32 is p, when work is not performed by the second pump 20, the discharge pressure P2 of the second pump 20 is lower than about 0.2 p. Accordingly, when the discharge pressure P1 of the first pump 10 is greater by 0.8 p or more than the discharge pressure of the second pump 20, it may be determined that work is not performed by the second pump 20, but is performed by the first pump 10 only. In this case, a reference difference pressure may be set as 0.8 p.

In this way, the determining of whether the current working state is a single operation is performed only with the discharge pressures P1 and P2 of the first pump 10 and the second pump 20, thus negating the need for additional components.

When the current working state is determined as a single operation, the controller 60 outputs a pump control signal in step S120 to the first tilting angle control unit 12 to make the discharge pressure P1 of the first pump 10 a first reference pressure or less, which is less than or the same as a swing relief pressure. Here, when the swing relief pressure is p, the first reference pressure may be set to below p, and may be set to p in consideration of a swing driving responsiveness.

Figure 2:
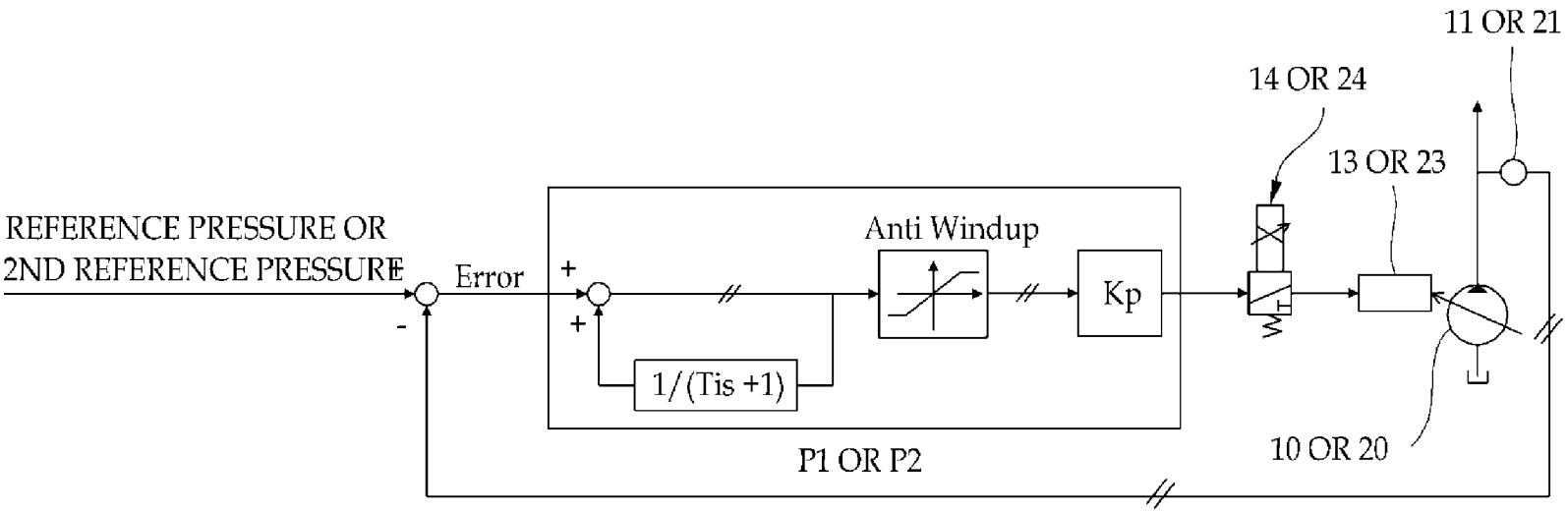
FIG. 2 is a control block diagram for illustrating an integral proportional control process in the controller in FIG. 1.
Figure 4:
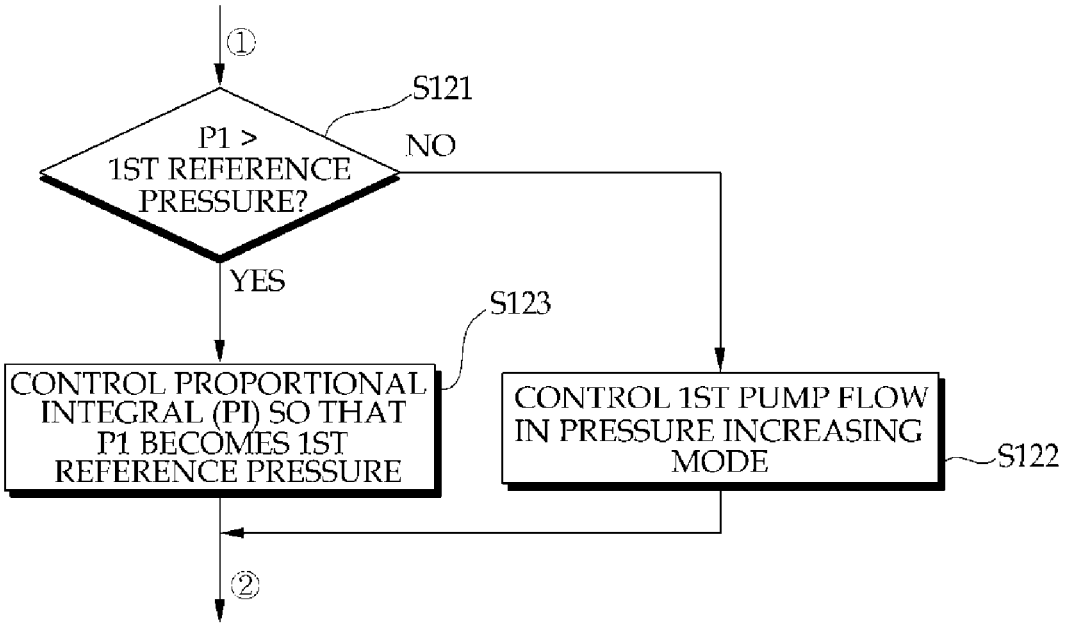
FIG. 4 is a flowchart for illustrating Step S120 in FIG. 3.

Referring to FIG. 4, to describe step S120 in more detail, when the controller 60 determines that the current working state is a single operation, it is determined whether the discharge pressure P1 of the first pump 10 is greater than the first reference pressure in step S121. When it is determined that the discharge pressure P1 of the first pump 10 is less than the first reference pressure, the controller 60, as illustrated in FIG. 6, in consideration of the responsiveness of the swing motor 30, outputs a current command corresponding to the pressure increasing mode via a pump control signal to the first EPPR valve 14, and thus, the flow of the first pump 10 is controlled in pressure increasing mode in step S122. On one hand, when the discharge pressure P1 of the first pump 10 is determined to be greater than the first reference pressure, the controller 60 controls the first pump 10 in pressure decreasing mode in step S123. Here, the controller 60, as illustrated in FIG. 2, sets the first reference pressure as a target value, and sets the discharge pressure P1 of the first pump 10 and the first reference pressure as error values to perform proportional integral control (PI control).

Here, while pressure decreasing mode is exemplified in FIG. 6 as outputting a current command 3*i* as a pump control signal, pressure decreasing mode denotes that a current command higher than in pressure increasing mode is output as a pump control signal, and the current command of the pressure decreasing mode to be output to the first EPPR valve 14 is determined by the PI control.

Likewise, for the single operation, by controlling the flow from the first pump 10 to maintain the discharge pressure of the first pump 10 below the swing relief pressure, the working fluid drained through the swing relief valve 32 may be minimized, and thus, fuel efficiency may be improved.

In step S110, when the current working state is determined not to be a single operation, the controller 60 outputs a pump control signal in step S130 to the first and the second tilting angle control unit 12 and 22, to make the greater pressure from among the discharge pressure P1 of the first pump and the discharge pressure P2 of the second pump 20 equal to or less than a second reference pressure that is less than or equal to the main relief pressure and greater than the swing relief pressure. That is, when the swing relief pressure is p and the main relief pressure is 1.2 p, the second reference pressure may be set greater than p and less than 1.2 p, and the second reference pressure may be set at 1.2 p in consideration of the responsiveness of the work tool actuator 40.

Figure 5:
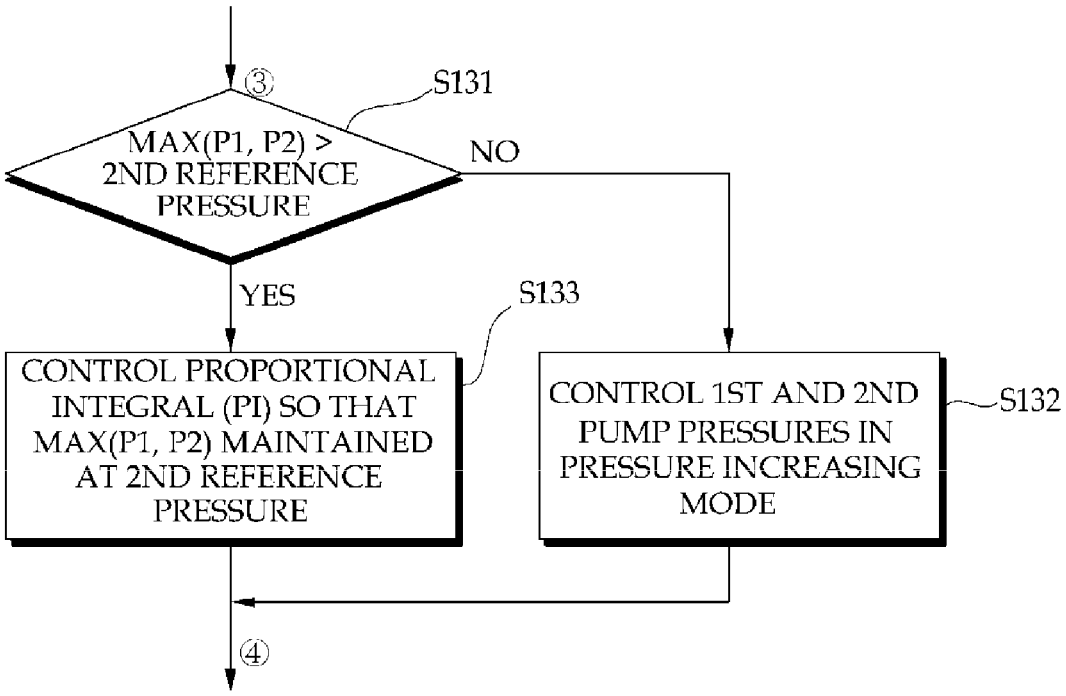
FIG. 5 is a flowchart for illustrating Step S130 in FIG. 3.

Referring to FIG. 5, to provide a more detailed description of step S120, when the controller 60 determines that the current working state is not a single operation, it is determined whether the greater pressure from among the discharge pressure P1 of the first pump 10 and the discharge pressure P2 of the second pump 20 is greater than the second reference pressure. When it is determined that the greater pressure from among the discharge pressure P1 of the first pump 10 and the discharge pressure P2 of the second pump 20 is less than the second reference pressure, the controller 60, in consideration of the responsiveness of the work tool actuator 40 as illustrated in FIG. 6, outputs a current command corresponding to the pressure increasing mode via the pump control signal to the first and the second EPPR valve 14 and 24, and controls the flow of the first and the second pump 10 and 20 in step S132 in pressure increasing mode. On the other hand, when it is determined that the greater pressure from among the discharge pressure P1 of the first pump 10 and the discharge pressure P2 of the second pump is greater than the second reference pressure, the controller 60 controls the flow of the first and the second pump 10 and 20 in pressure decreasing mode in step S133. Here, the controller 60, as illustrated in FIG. 2, sets the second reference pressure as a target value, sets the greater pressure from among the discharge pressure P1 of the first pump 10 and the discharge pressure P2 of the second pump 20 and the second reference value as error values, and performs Integral Proportional (PI) control.

The invention claimed is:

1. A device for controlling a hydraulic pump of construction machinery, the device having a first pump supplying working fluid through a swing control valve to a swing motor, and a second pump supplying working fluid through a work tool control valve to a work tool actuator, the device comprising:

a first tilting angle control unit for controlling a discharge flow of the first pump by controlling a tilting angle of the first pump according to an input pump control signal; and a controller deducting a discharge pressure (P2) of the second pump from a discharge pressure (P1) of the first pump to calculate a pump difference pressure (P1-P2), comparing the calculated pump difference pressure (P1-P2) to a reference difference pressure and, when the calculated pump difference pressure (P1-P2) is greater than the reference difference pressure, outputting the pump control signal to the first tilting angle control unit to make the discharge pressure (P1) of the first pump equal to or less than a first reference pressure that is less than or equal to a swing relief pressure.

2. The device of claim 1, further comprising:

a second tilting angle control unit controlling a discharge flow of the second pump by controlling a tilting angle of the second pump according to the pump control signal input from the controller, wherein the controller outputs the pump control signal to the first and the second tilting angle control units and, such that when the pump difference pressure (P1-P2) is less than the reference difference pressure, a greater discharge pressure from among the discharge pressure (P1) of the first pump and the discharge pressure (P2) of the second pump is made greater than the swing relief pressure and less than a main relief pressure.

3. The device of claim 1, wherein the first tilting angle control unit comprises:

a first regulator controlling a tilting angle of the first pump according to an input pilot pressure; and a first electronic proportional pressure reduction valve controlling the pilot pressure input to the first regulator according to the input pump control signal.

4. A method for controlling a hydraulic pump for construction machinery, having a first pump supplying working fluid through a swing control valve to a swing motor, and a second pump supplying working fluid through a work tool control valve to a work tool actuator the method comprising:

a) a step of calculating a pump difference pressure (P1-P2) by deducting a discharge pressure (P2) of the second pump from a discharge pressure (P1) of the first pump;

b) a step of a determining that a current working state is a single operation when the pump difference pressure (P1-P2) is greater than a reference difference pressure, and determining that the current working state is not a single operation when the pump difference pressure (P1-P2) is less than the reference difference pressure; and c) a step of controlling a discharge flow of the first pump by making the discharge pressure (P1) of the first pump equal to or less than a first reference pressure that is less than or equal to a swing relief pressure, when the current working state is determined to be a single operation.

5. The method of claim 4, further comprising:

d) a step of controlling discharge flows of the first and the second pump and by making a greater discharge pressure from among the discharge pressure (P1) of the first pump and the discharge pressure (P2) of the second pump equal to or less than a second reference pressure that is greater than the swing relief pressure and less than a main relief pressure, when the current working state is determined to not be a single operation.

6. The method of claim 4, wherein step c) comprises:

c1) a step of comparing the discharge pressure (P1) of the first pump with the first reference pressure; and c2) a step of controlling a discharge flow of the first pump by maintaining the discharge pressure (P1) of the first pump at the first reference pressure, when the discharge pressure (P1) of the first pump is greater than the first reference pressure.

* * * * *